US006974530B2

(12) United States Patent
Bonkass et al.

(10) Patent No.: US 6,974,530 B2
(45) Date of Patent: Dec. 13, 2005

(54) METHOD AND SYSTEM FOR CONTROLLING ION DISTRIBUTION DURING PLATING OF A METAL ON A WORKPIECE SURFACE

(75) Inventors: Matthias Bonkass, Dresden (DE); Axel Preusse, Radebeul (DE)

(73) Assignee: Advanced Micro Devices, Inc., Austin, TX (US)

( * ) Notice: Subject to any disclaimer, the term of this patent is extended or adjusted under 35 U.S.C. 154(b) by 256 days.

(21) Appl. No.: 10/358,969

(22) Filed: Feb. 5, 2003

(65) Prior Publication Data

US 2004/0000487 A1 Jan. 1, 2004

(30) Foreign Application Priority Data

Jun. 28, 2002 (DE) ..... 102 29 001

(51) Int. Cl.[7] ..... C26D 7/00

(52) U.S. Cl. ..... 205/96; 118/400; 118/429; 204/242; 204/275.1; 204/279; 204/DIG. 7; 205/123; 205/148; 427/430.1

(58) Field of Search ..... 204/279, DIG. 7, 204/242, 275.1; 205/96, 123, 148; 118/400, 118/429; 427/430.1

(56) References Cited

U.S. PATENT DOCUMENTS 6,103,085 A * 8/2000 Woo et al. ..... 205/143
6,106,687 A * 8/2000 Edelstein ..... 205/98
6,254,742 B1 * 7/2001 Hanson et al. ..... 204/279

FOREIGN PATENT DOCUMENTS

DE 32 28 292 C2 12/1992 ..... C25D 7/00

* cited by examiner

*Primary Examiner*—Roy King
*Assistant Examiner*—William T. Leader
(74) *Attorney, Agent, or Firm*—Williams, Morgan & Amerson, P.C.

(57) ABSTRACT

The flow of electrolyte and/or of ions is controlled by a diffuser element provided in a plating reactor, wherein, in one embodiment, the diffuser element comprises a mechanical adjustment mechanism to adjust the effective size of passages of the diffuser element. In another embodiment, the diffuser element comprises at least two patterns of passages that are movable relatively to each other so as to adjust an overlap and thus an effective size of the corresponding passages. Moreover, the path of ions within the plating reactor may be controlled by an electromagnetically driven diffuser element so that a required thickness profile on the workpiece surface may be obtained.

12 Claims, 7 Drawing Sheets

METHOD AND SYSTEM FOR CONTROLLING ION DISTRIBUTION DURING PLATING OF A METAL ON A WORKPIECE SURFACE

1. Field of the Present Invention

The present invention relates to depositing a metal on a workpiece surface, using a reactor for electroplating or electroless plating, and, more particularly, to the distribution of electrolyte flow and/or ion flow across the workpiece surface.

2. Description of the Prior Art

In many technical fields, the deposition of metal layers on a workpiece surface is a frequently employed technique. For efficiently depositing relatively thick metal layers on a workpiece surface, plating, in the form of electroplating or electroless plating, has proven to be a viable and cost-effective method and, thus, plating has become an attractive deposition method in the semiconductor industry.

Nowadays, copper has become a preferred candidate in forming metallization layers in sophisticated integrated circuits due to the superior characteristics of copper and copper alloys in view of conductivity and resistance to electromigration compared to, for example, the commonly used aluminum. Since copper may not be deposited very efficiently by physical vapor deposition, for example by sputter deposition, with a layer thickness of the order of 1 $\mu$m and more, electroplating of copper and copper alloys is the preferred deposition method in forming metallization layers. Although electroplating of copper is a well-established technique, reliably depositing copper over large-diameter wafers, having a patterned surface including trenches and vias, is a challenging task for process engineers. For example, forming a metallization layer of an ultra large scale integration device requires the reliable filling of wide trenches with a width of the order of micrometers and also requires the filling of vias and trenches having a diameter or width of 0.2 $\mu$m or even less. The situation gains even more in complexity as the diameters of the substrates tend to increase. Currently, eight or even ten-inch wafers are commonly used in a semiconductor process line. Thus, great efforts are being made in the field of copper plating to provide the copper layer as uniformly as possible over the entire substrate surface.

With reference to FIG. 1, a typical prior art electroplating system will now be described to illustrate the problems involved in electroplating copper in more detail.

In FIG. 1*a*, there is shown a typical conventional electroplating system 100 including a reactor vessel 101 in which a first electrode 102, in this case the anode, is provided. In this example, a so-called fountain type reactor is considered, in which an electrolyte solution is directed from the bottom of the reactor vessel 101 to the top side and is then re-circulated by a pipe 103 connecting an outlet 104 with an inlet 105 provided as a passage through the anode 102. Circulating an electrolyte, as indicated by arrows 106, may be accomplished by a corresponding pump 107. The system 100 further comprises a substrate holder 108 that is configured to support a workpiece 109, such as a semiconductor wafer, in a manner to expose a surface to be plated to the electrolyte. Moreover, the substrate holder 108 may be configured to act as a second electrode, in this case the cathode, and to provide for the electrical connection to a power source 110. A diffuser element 111 is provided between the anode 102 and the substrate holder 108 to influence the path of the electrolyte flow moving toward the workpiece 109, as indicated by arrows 112. The diffuser element 111 comprises a plurality of openings 113 to at least partially control the amount and direction of the electrolyte passing the diffuser element 111.

FIG. 1*b* schematically shows a typical pattern of the openings 113 of the diffuser element 111.

Prior to installing the workpiece 109 on the substrate holder 108, a thin seed layer, typically provided by sputter deposition, is formed on the surface of the workpiece 109 that will receive the metal layer. Then, the workpiece 109 is mounted on the substrate holder 108, wherein small contact areas (not shown for the sake of simplicity) provide electrical contact to the power source 110 via the substrate holder 108. By activating the pump 107 and applying an appropriate voltage between the anode 102 and the substrate holder 108, an electrolyte flow is created within the reactor vessel 101. The electrolyte entering the reactor vessel 101 at the inlet 105 is directed towards the workpiece 109 and passes through the openings 113 of the diffuser element 111. In many electroplating systems, such as system 100, at least one of the anode 102, the diffuser element 111, and the substrate holder 108 may be rotated to improve deposition uniformity across the entire surface of the work piece 109. In particular, the openings 113 form a pattern that aids in obtaining a uniform metal thickness, since the local deposition rate of metal on a specific area of the surface of the workpiece 109 depends on the number of ions arriving at this area. Thus, by correspondingly distributing the electrolyte flow via the openings 113 and the rotation of the anode 102 and/or the diffuser element 111 and/or the substrate holder 108, the local deposition rate may be influenced. Although the electroplating system 100 allows to obtain satisfactory metal deposition results for small-diameter workpieces, such as two or four inch wafers, a significant thickness variation may occur with workpieces of a diameter in the range of six to ten and more inches.

Usually, in forming metallization layers by the so-called damascene technique, vias and trenches are filled with metal and a certain degree of excess metal has to be provided so as to reliably fill the vias and trenches. Subsequently, the excess metal has to be removed to ensure electrical insulation between adjacent trenches and vias and to provide a planar surface for the formation of further metallization layers. A preferred technique for removing excess metal and planarizing the substrate surface is chemical mechanical polishing (CMP), in which the surface material to be removed is subjected to a chemical reaction and is simultaneously mechanically removed. It turns out, however, that chemically mechanically polishing a patterned surface provided on a large-diameter substrate is per se an extremely complex process. The problems involved in the CMP process are even exacerbated when the thickness of the metal layer to be removed varies across the surface of the substrate. Typically, the CMP process may exhibit a certain intrinsic non-uniformity, depending on the type of materials to be removed and the specific process conditions, and the like, and the combined non-uniformity of the metal deposition process and the CMP process may result in unacceptable variations of the finally obtained metal trenches and vias.

Thus, CMP process specific variations may be taken into account during the plating process by appropriately modifying the diffuser element 111 so as to obtain a modified electrolyte flow at the work piece 109. For example, if process conditions of the subsequent CMP process result in a so-called center fast polishing, i.e., the polishing rate in the center of the workpiece 109 is higher than at the periphery thereof, additional openings 113 may be provided in the center of the diffuser element 111 and/or a plurality of openings 113 at the periphery of the diffuser element 111 may be blocked by, for example, an appropriate tape to create a modified diffuser configuration. After modifying the diffuser element 111, it is reinserted into the reactor vessel 101, wherein the electrolyte flow at the center of the workpiece 109 compared to the peripheral region is increased and results in an increased final metal layer thickness, thereby to at least partially compensate for the different polishing rates in the subsequent CMP process.

Although the adaptation of the diffuser element 111 to given polishing requirements allows to significantly improve the uniformity of the finally obtained metal layer, the process described above is cumbersome, in that it requires dismantling the diffuser element 111 and reinstalling after modification of the diffuser element. This is especially disadvantageous, when a plurality of test runs has to be carried out to find the appropriate pattern configuration for the diffuser element 111.

Accordingly, in view of the above problems, a need exists to more efficiently modify the deposition rate in depositing a metal by electroplating or electroless plating.

SUMMARY OF THE INVENTION

Generally, the present invention is directed at a method, devices and systems for modifying an electrolyte flow and/or an ion flow to a workpiece surface in a reactor, such as an electroplating reactor or a reactor allowing an electroless deposition, wherein the effect of a diffuser element on the directionality of the electrolyte flow and/or the ion flow is mechanically and/or electromagnetically adjustable, without requiring the removal and reinstallation of the diffuser element.

It should be noted that the term "plating" used herein is to cover both the process of electroplating and the process of electroless plating. Accordingly, unless otherwise specified in the description and the claims, a "plating reactor" is meant to cover any reactor that is used for electroplating or for electroless plating of metals.

According to one illustrative embodiment of the present invention, a diffuser element for a plating reactor comprises a plurality of passages for guiding an electrolyte. The diffuser element further comprises an adjustment mechanism that is configured to adjust an effective size of the passages.

In a further illustrative embodiment of the present invention, a diffuser element for a plating reactor comprises a first pattern of passages and a second pattern of passages. The first and the second patterns of passages are movable relatively to each other to vary a degree of overlap of the passages in the first and second patterns to control fluid flow through the first and second patterns.

In accordance with a further illustrative embodiment of the present invention, a diffuser element for a plating reactor comprises a deflection unit that is configured to electromagnetically control the trajectories of metal ions passing through the diffuser element.

In a further embodiment of the present invention, a deflection system for use in a plating reactor comprises a diffuser element that allows the electromagnetic control of the trajectories of metal ions passing through the diffuser element. Moreover, the deflection system comprises a control unit that is configured to control the diffuser element so as to obtain a required deflection of the metal ions.

In a further embodiment of the present invention, a plating reactor is provided, including at least one of the diffuser elements according to the illustrative embodiments as described above.

In a further embodiment of the present invention, a method of plating a workpiece surface comprises providing a workpiece including a surface for receiving a metal layer. The workpiece is then mounted on a substrate holder. The method further comprises providing a diffuser element in front of the workpiece surface, wherein the diffuser element allows modifying an electrolyte flow therethrough by actuating an adjustment mechanism, which varies an effective size of passages through the diffuser element. Finally, electrolyte is directed to the workpiece surface to deposit a metal thereon.

In a further illustrative embodiment of the present invention, a method of plating a workpiece surface comprises providing a workpiece, including a surface for receiving a metal layer and mounting the workpiece on a substrate holder of a plating reactor. The method further comprises providing a diffuser element in front of the workpiece, wherein the diffuser element is adapted to allow the modification of trajectories of ions by actuating an electromagnetic deflection unit. Finally, electrolyte is directed to the workpiece surface to form a metal layer having a thickness substantially determined by the diffuser element.

BRIEF DESCRIPTION OF THE DRAWINGS

Further advantages, objects and embodiments of the present invention are defined in the appended claims and will become more apparent with the following detailed description when taken with reference to the accompanying drawings, in which:

DETAILED DESCRIPTION OF THE INVENTION

Figure 1A:
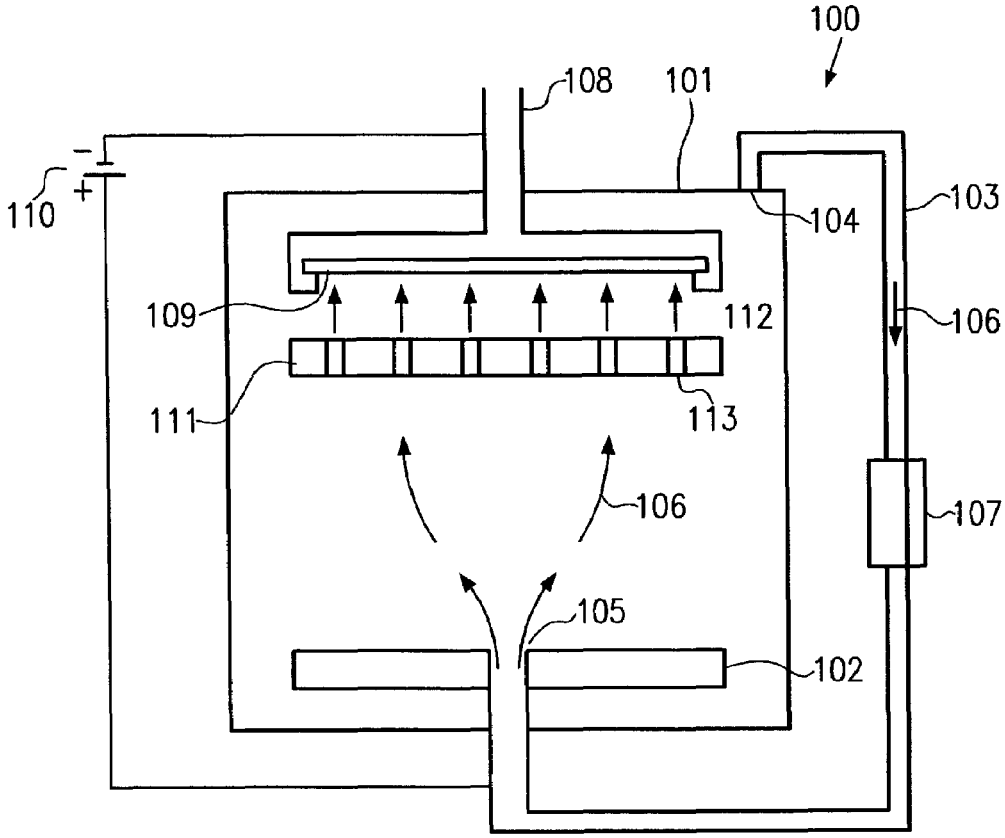
Fig.1a (Prior Art)
FIGS. 1*a* and 1*b* schematically show a typical prior art electroplating system and a top view of a diffuser element used in the electroplating system, respectively.
Figure 1B:
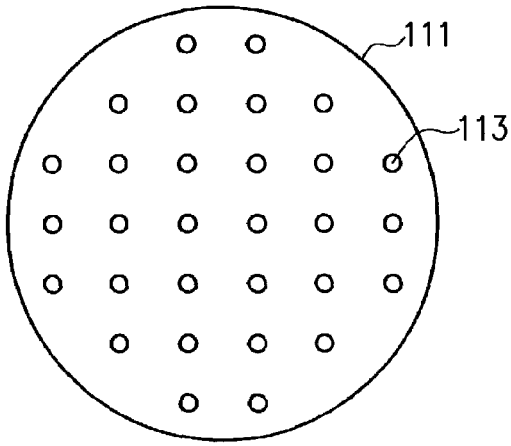
Fig.1B (Prior Art)

While the present invention is described with reference to the embodiments as illustrated in the following detailed description, as well as in the drawings, it should be understood that the following detailed description, as well as the drawings, are not intended to limit the present invention to the particular illustrative embodiments disclosed, but rather the described illustrative embodiments merely exemplify the various aspects of the present invention, the scope of which is defined by the appended claims.

It is further to be noted that the detailed description will refer to electroplating of copper on substrates, such as those typically used in semiconductor fabrication. It will be readily appreciated, however, that the present invention is applicable to any plating process, either electroless or with an externally impressed current (electroplating), of any types of substrates. Moreover, although the description will refer to a fountain type plating reactor, for example as schematically illustrated in FIG. 1*a*, other types of reactors, such as electrolyte baths, and the like may be used. In particular, the embodiments allowing an electromagnetic control of ion movement may effectively be used in electrolyte bath type reactors.

Figure 2A:
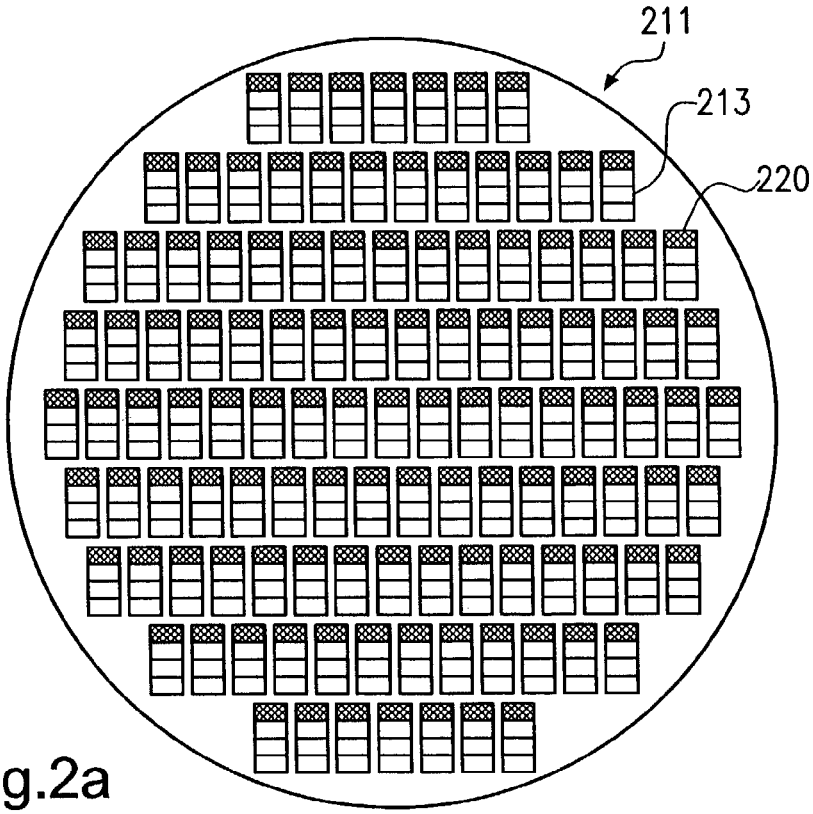
FIGS. 2*a*–2*c* schematically show various views of a diffuser element according to one illustrative embodiment of the present invention.

FIG. 2*a* schematically shows a top view of a diffuser element 211 including a plurality of passages 213. Some or all of the passages 213 comprise an adjustment mechanism 220 that allows varying an effective size of the passages 213.

Figure 2B:
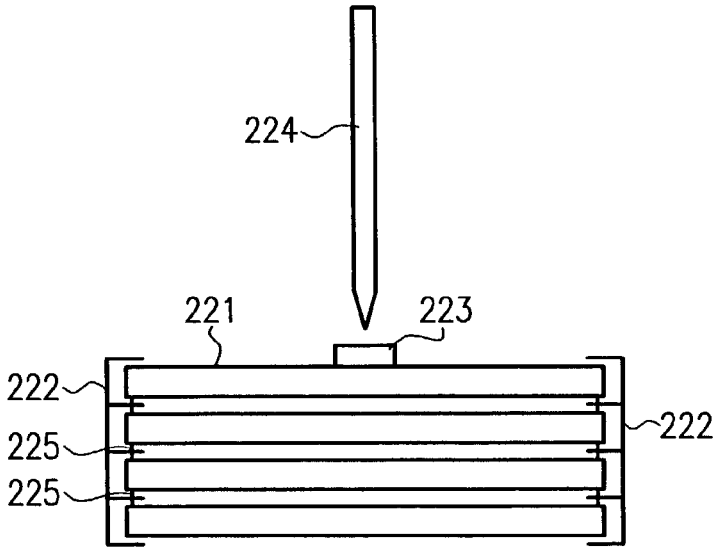

FIG. 2*b* shows a sectional view of one opening 213 including the adjustment mechanism 220, which is comprised of four cover elements 221 that are guided by rail like members 222 such that the four cover elements 221 may be actuated by engaging a pin 224 with an engagement element 223 attached to upper most cover element 221. The cover elements 221 further comprise stop elements 225 that are configured and positioned to engage with corresponding stop elements 225 of underlying and/or overlying cover elements 221, as will be described with reference to FIG. 2*c*.

Figure 2C:
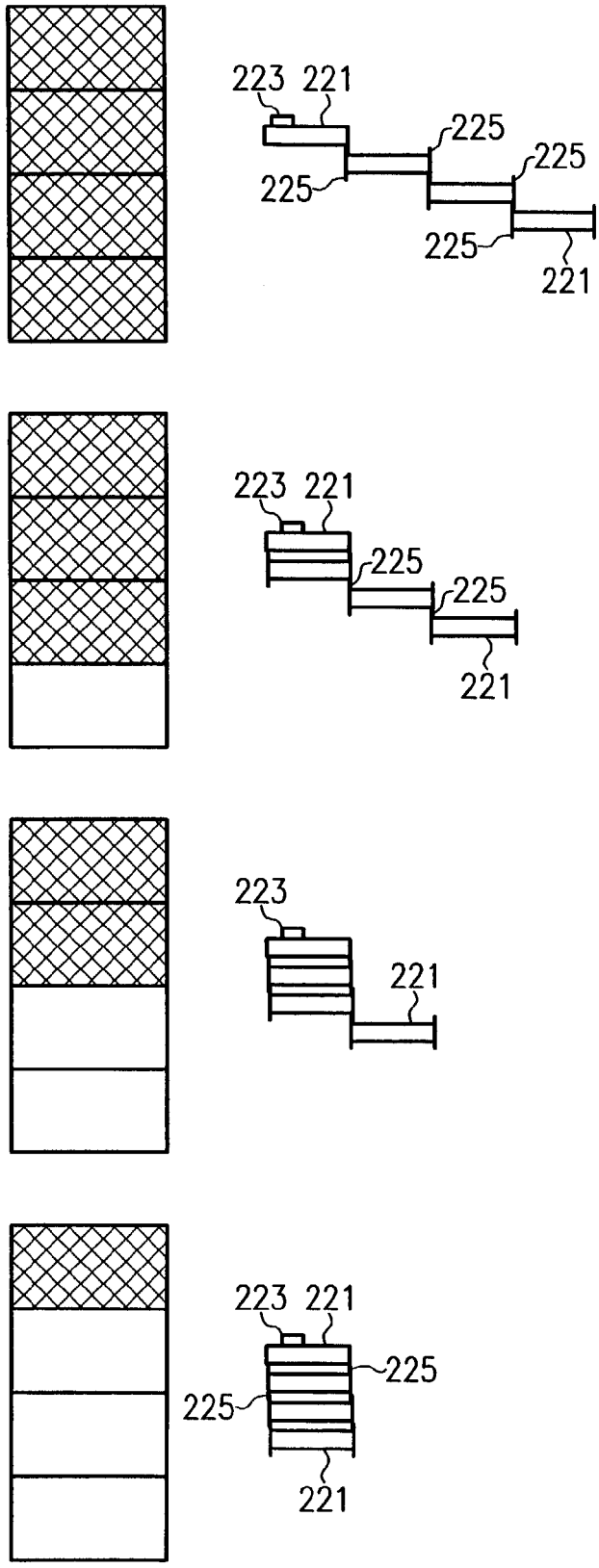

FIG. 2*c* shows a side view of the opening 213 of FIG. 2*b*. For convenience, the rail like member 222 is not shown. From bottom to top, four different positions of the adjustment mechanism 213 are shown, corresponding to a fully open, a half-open, a ¾-close and a fully closed position, respectively. FIG. 2*c* shows the arrangement of the cover elements 221 and the corresponding stop elements 225 when the upper cover element 221 is actuated by, for example, an operator by means of the pin 224, to sequentially bring the opening in the fully open position when starting from the fully closed position. While the fully open position allows a maximum flow of electrolyte through the respective passage 213, the fully closed position substantially prevents electrolyte flow through the opening 213.

In operation, the diffuser element 211 may be inserted into a reactor vessel, such as the vessel 101 in FIG. 1*a*, instead of or additionally to the diffuser element 111, and the effective sizes of the passages 213 are adjusted by selecting one of the positions as shown in FIGS. 2*a* and 2*b*. For example, if a dome-like thickness profile is desired, the central passages 213 may remain in a position as shown in FIG. 2*a*, whereas with increasing distance from the center of the diffuser element 211, the adjustment mechanisms 220 may be set successively to the positions as shown in FIG. 2*b* to gradually reduce electrolyte flow to the periphery of the work piece 109.

In one example, the configuration of the diffuser element 211 may be adjusted such that the passages 213 at the periphery of the diffuser element 211 are substantially completely closed, or the passages 213 may, in an alternating fashion, be completely closed or brought into the position with only one section opened, as shown in the middle of FIG. 2*b*, to reduce the electrolyte flow to the work piece edge. Typically, the deposition rate at the edge of the work piece 109 is increased, since the magnitude of the current and thus the deposition rate is higher at the locations that are in direct contact with the cathode 108.

After correspondingly adjusting the effective sizes of the passages 213, the reactor vessel 101 is operated as described with reference to FIG. 1*a*, wherein the diffuser element 211 correspondingly affects the electrolyte flow towards the workpiece 109 and thus generates the desired thickness profile.

As will be readily appreciated, the shape and size of the passages 213 may vary, and the rectangular shape featuring four different positions is only exemplary. For instance, the adjustment mechanisms 220 may be configured to allow a continuous variation of the effective size of the passages 213. Moreover, although the shape of the diffuser element 211 is selected to substantially conform to the workpiece 109, i.e., in the present example to a semiconductor wafer of eight to ten inches, the diffuser element 211 may have any appropriate shape or size, wherein, for instance, the size and shape of the workpiece 109 is taken into account by correspondingly actuating the adjustment mechanisms 220 to obtain a diffuser configuration as required. For example, if a four-inch workpiece 109 is to be plated, all of the passages 213 having a distance that exceeds the diameter of the workpiece 109 may be completely closed and the effective size of the remaining central passages 213 may be adjusted to conform to process requirements. Thus, a single diffuser element, such as the element 211, may suffice to allow processing of workpieces 109 of different sizes and shapes.

Figure 3A:
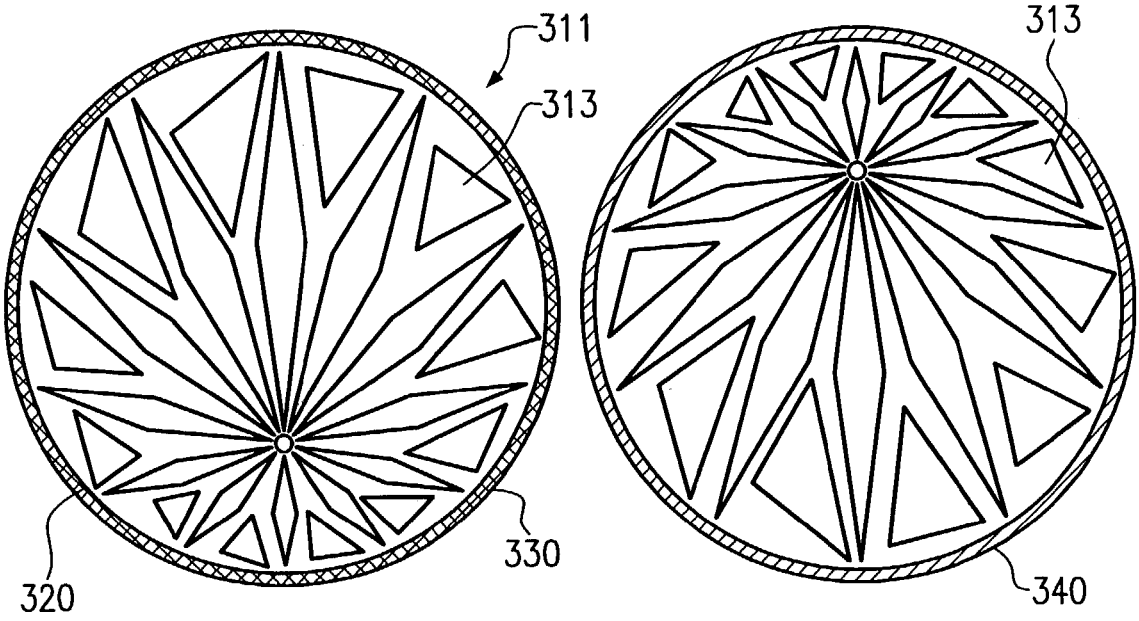
FIGS. 3*a* and 3*b* schematically show top views of a further illustrative embodiment of a diffuser element that is comprised of two patterns of passages.

FIG. 3*a* schematically shows a further illustrative embodiment of the present invention. A diffuser element 311 is comprised of a first diffuser plate 330 and a second diffuser plate 340. The first and the second diffuser plates 330, 340 include passages 313 of suitable size and shape. In the illustrative example shown in FIG. 3*a*, the passages 313 of the first and second diffuser plates 330, 340 are arranged such that no symmetry with respect to the corresponding centers of the diffuser plates 330, 340 is obtained.

Figure 3B:
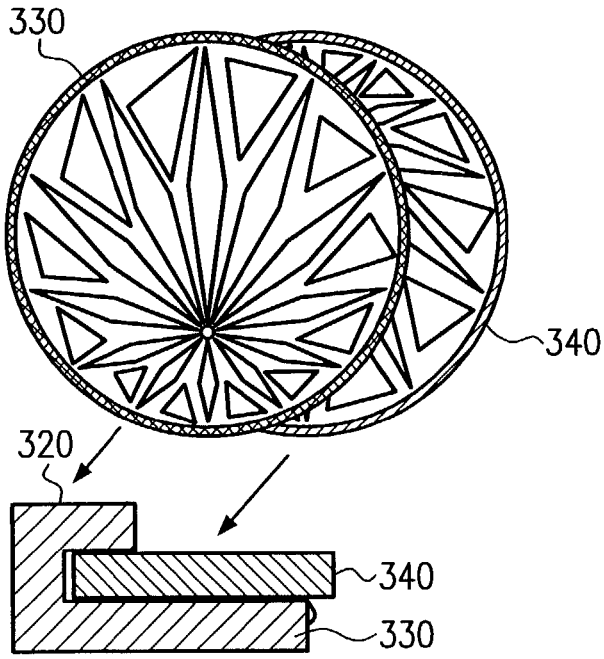

In one illustrative embodiment, the first diffuser plate 330 comprises an edge portion 320 having a substantially U-shaped cross-section, as shown in FIG. 3*b*, so as to engage with the second diffuser plate 340. Thus, the edge portion 320 represents a simple adjustment mechanism to adjust the angular position of the first and second diffuser plates 330, 340 relatively to each other. By varying an angle of rotation with respect to a central axis (not shown) of the first and second diffuser plates 330, 340, the effective size and shape of the passages 313 maybe adjusted to conform with process requirements.

As will readily be appreciated, the arrangement of FIGS. 3*a* and 3*b* is only of illustrative nature and a huge variety of sizes and shapes of the passages 313, including off-center symmetric designs and center symmetric designs, may be employed. For instance, a plurality of circular openings may be provided in an identical manner in the first and the second diffuser plates 330, 340 and by selecting a corresponding rotational angle with respect to each other, the effective size of the circular openings can continuously be varied.

Moreover, a variety of other-means may be provided as the adjustment mechanism 320 instead of the U-shaped edge portion of the first diffuser plate 330. For example, a plurality of pins (not shown) may be provided at the periphery of the first diffuser plate 330, and a corresponding plurality of openings (not shown) may be provided at the periphery of the second diffuser plate 340, so that each pin is in engagement with a corresponding opening. The distance of the adjacent pins or openings is selected to correspond to a minimum required rotational displacement of the first and second diffuser plates 330 and 340.

Other means for adjustably fixing the first and the second diffuser plates 330, 340 are well-known in the art and may include fasteners such as clips, clamps, screws, and the like. Preferably, the adjustment mechanisms 220, 320, as well as the remaining parts of the diffuser elements 211, 311, have electrically non-conductive surfaces.

Preferably, means are selected as the adjustment mechanism 320 that allow easy positioning of the first and the second diffuser plates 330, 340 relatively to each other within the reactor vessel 101, such as the above mentioned positioning pins and corresponding holes and/or clamps and/or clips so that the first and second diffuser plates 330 and 340 may be readily positioned relatively to each other by an operator without the necessity of removing the diffuser element from the plating reactor.

As already pointed out with reference to FIG. 2, the peripheral portions of the first and second diffuser plates 330, 340 may also be designed so as to reduce electrolyte flow to the peripheral region of the workpiece 109 in order to compensate for the intrinsically higher copper deposition rate at the periphery.

Figure 4A:
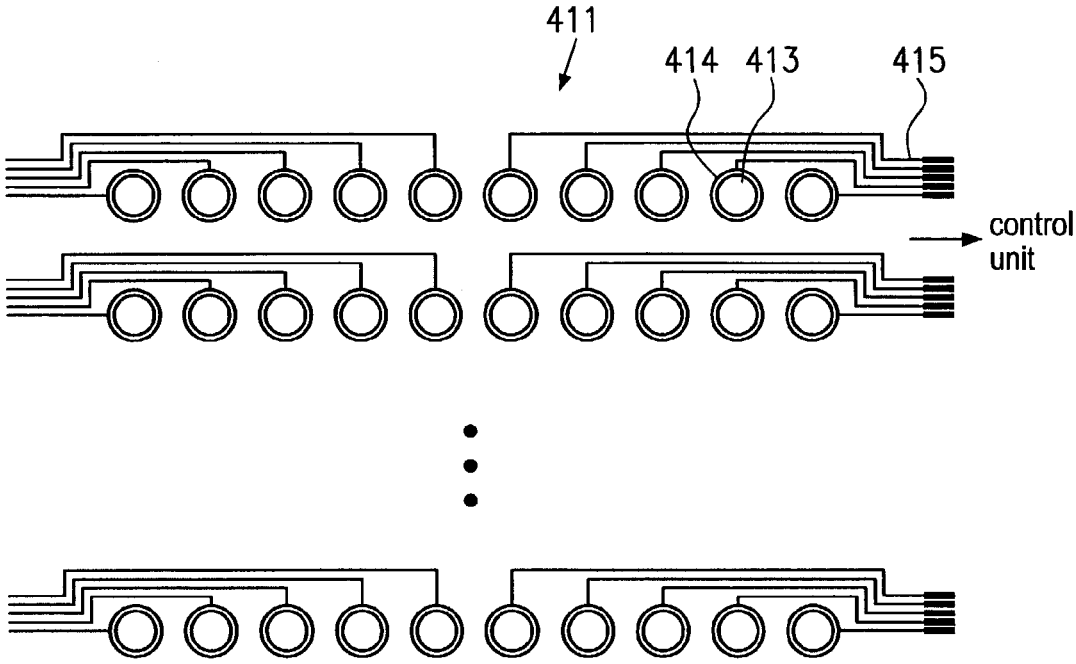
FIGS. 4*a* and 4*b* schematically show exemplary embodiments of a diffuser element having electromagnetic components to affect trajectories of ions moving through the diffuser element.

FIG. 4*a* schematically shows an exemplary embodiment of a diffuser element 411 that is configured to influence the electrical field prevailing between the anode 102 and the cathode 108. The diffuser element comprises a plurality of passages 413, the size and shape of which may be selected according to process requirements. In the example illustrated in FIG. 4*a*, the passages 413 are represented by circular openings. The passages 413 are enclosed by electrodes 414, which in turn are connected to respective leads 415. The electrodes 414 may be electrically insulated from each other, or may be connected to form specified groups of electrodes that may be driven by a single voltage supplied by a corresponding lead 415. In the embodiment illustrated in FIG. 4*a*, the electrodes 414 are individually connected to corresponding leads 415, which, in turn, may be connected to a control unit (not shown) that is configured to selectively supply a corresponding voltage to the individual electrodes 414. The electrodes 414 are coated by an insulating material, so that in operation no copper deposition occurs at the surface thereof.

In operation, a voltage is supplied to corresponding electrodes 414 or groups of electrodes 414 to vary a prevailing electrical field to form a specific flow pattern of the ions passing through the diffuser element 411. For instance, if a dome-like thickness profile is desired, the voltage applied to the central electrodes 414 may be selected less positively with respect to the voltage supplied to the anode 102 than at the periphery of the diffuser element 411 so that ions preferably pass through the central passages 413. By correspondingly selecting the voltage supplied to the electrodes 414, any appropriate modification of the electrical field may be obtained and thus the trajectories of the ions passing through the passages 413 may be influenced accordingly. Moreover, the electrodes 414 may not necessarily be provided on the diffuser element 411 but, instead, may be provided on a separate plate or frame that may be arranged downstream or upstream of a mechanical diffuser element, such as the element 111. Alternatively, a plurality of frame members each including electrodes 414 may be sequentially provided within the flow path of the ions to increase effectiveness.

Figure 4B:
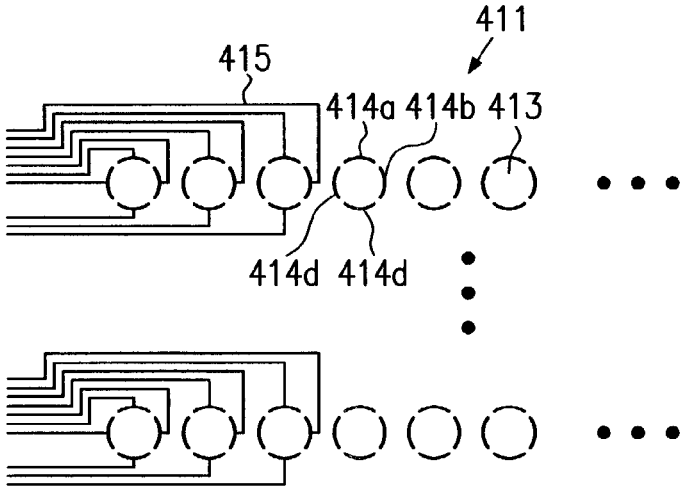

FIG. 4*b* schematically shows a further illustrative embodiment of the diffuser element 411, in which the passages 413 are enclosed by a plurality of electrode segments 414*a*, . . . , 414*d*. In the present example, four electrode segments are provided that are individually connected to a control unit (not shown) including a voltage source. As previously noted, the passages 413 and the corresponding electrode segments 414*a*, . . . , 414*d* may be grouped so that a plurality of passages 413 is driven by common leads 415, thereby reducing the number of leads at the cost of a decreased "resolution" of the diffuser element 411. Providing a plurality of electrode segments 414*a*, . . . , 414*d* instead of a single electrode allows to individually influence the trajectory of an ion passing through a corresponding passage 413. For example, the electrode segments 414*a*, . . . , 414*d* may be driven by the control unit in such a manner that an ion passing through the passage 413 is deflected in a required direction. For instance, passages 413 corresponding to the peripheral region of the workpiece 109 may be driven such that ions passing through the passages are directed to the center of the workpiece 109 to obtain a dome-like thickness profile. In contrast, if a bowl-like thickness profile is desired, the electrode segments of the central passages 413 are driven by corresponding voltages to deflect the ions to the periphery.

Moreover, the voltage applied to the electrode segments 414*a*, . . . , 414*d* may be supplied in a time-varying manner so that the deflection direction of the ions passing through the passages 413 varies correspondingly in a time-dependent manner. An embodiment that allows a time-varying deflection of the ions is particularly useful in arrangements, in which the reactor vessel 101 is operated with a low externally-induced electrolyte flow, or as an electrolyte bath, where the number of ions arriving at the work piece 109 is primarily determined by the electric field created by the anode 102 and the cathode 108 rather than by circulating the electrolyte. The time-varying deflection angle may then ensure a substantially homogeneous distribution of the copper deposited on the workpiece 109. Moreover, a corresponding arrangement may render the rotation of the anode 102 and/or the cathode 108 as obsolete, thereby significantly simplifying the mechanical construction of the electroplating system 100.

Figure 5:
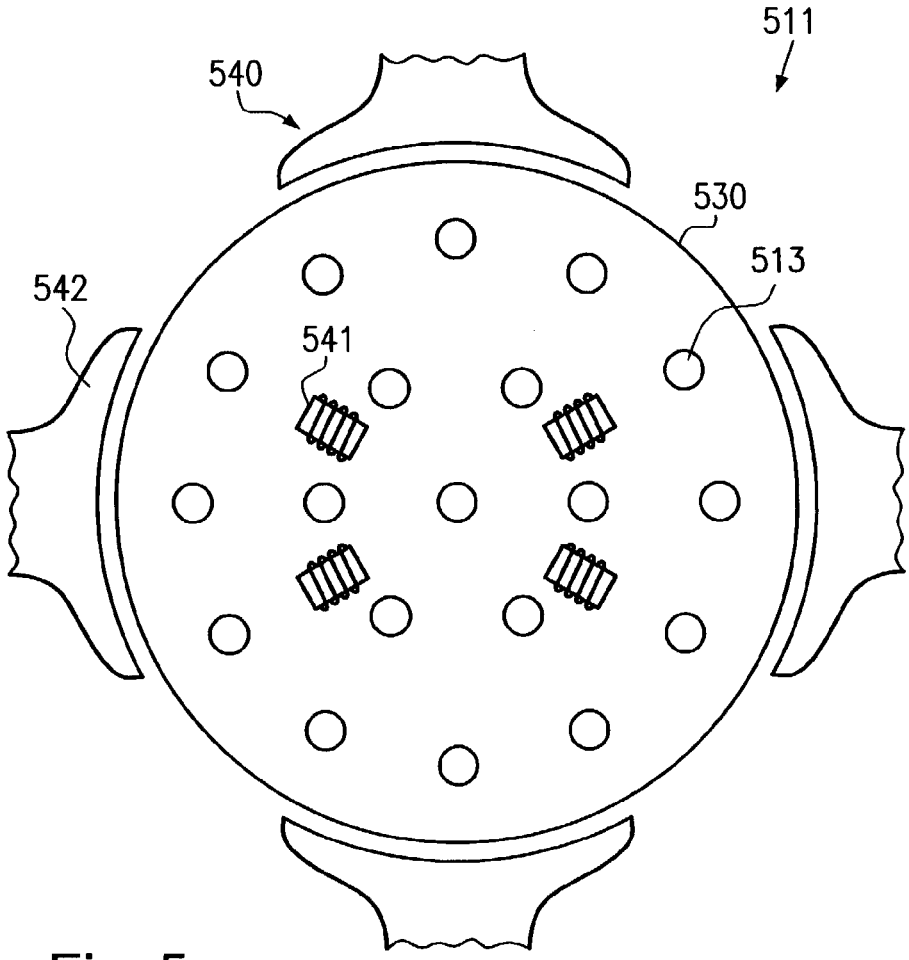
FIG. 5 schematically shows a further illustrative embodiment of a diffuser element for electromagnetically influencing ion trajectories.

FIG. 5 schematically shows further embodiments of electromagnetic diffuser elements. In FIG. 5, a diffuser element 511 comprises a diffuser plate 530, including a plurality of passages 513. Although the passages 513 are depicted as circular openings, it should be appreciated that, as already explained with reference to FIGS. 2 and 3, any appropriate size and shape may be selected for the passages 513. On or spaced apart from the diffuser plate 530, an electromagnetic diffuser portion 540 is provided which includes a plurality of central solenoids 541 and a plurality of peripheral solenoids 542. The solenoids 541, 542 are connected to a control unit (not shown) that is configured to provide the required currents for appropriately driving the solenoids 541 and 542.

Upon powering the solenoids 541 and/or the solenoids 542, a magnetic field is generated that deflects ions passing through the diffuser element 511 in conformity with the currents applied to the respective solenoids. For example, the peripheral solenoids 542 may be driven so as to "focus" ions into the central region of the workpiece 109 to obtain a dome-like thickness profile. In contrast thereto, the peripheral solenoids 542 may be powered to draw ions to the periphery of the workpiece 109 so as to obtain a bowl-shaped thickness profile. Alternatively or additionally, the central solenoids 541 may be operated to obtain the required thickness profile. As will be readily appreciated, the arrangement in FIG. 5 is only of an illustrative nature and any appropriate arrangement of the solenoids may be selected. For example, in some embodiments, the provision of the central solenoids 541 is sufficient to obtain the required deflection of ions passing through the diffuser element 511. In other embodiments, the peripheral solenoids 542 may be sufficient to generate the required thickness profile. Moreover, the number and shape of the solenoids 542, 541 may be selected in accordance with process requirements. In other embodiments, the electromagnetic diffuser portion 540 may be provided without a diffuser plate 530, whereby the required ion distribution on the workpiece 109 is generated solely by the electromagnetic diffuser portion 540. A corresponding arrangement is advantageous in plating systems having no or only a low externally induced flow rate of the electrolyte.

In other embodiments, the solenoids 541 and/or 542 may be combined with electrode arrangements, such as shown in FIGS. 4*a* and 4*b*, to provide for the required deflection of ions passing through the respective diffuser element.

Figure 6:
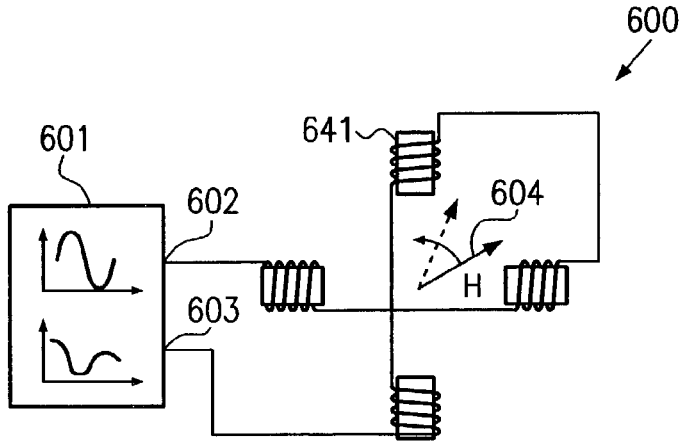
FIG. 6 schematically shows a control unit connected to a portion of an electromagnetic diffuser element.

FIG. 6 schematically shows a system 600 for operating electromagnetic diffuser elements as explained with reference to FIGS. 4*a*, 4*b* and 5. For the sake of simplicity, a corresponding diffuser element is represented by solenoids 641 that are arranged in a similar fashion as the central solenoids 541 in FIG. 5. It should be noted, however, that the principle of controlling the deflection of ions passing through a diffuser element is similar to any of the embodiments explained with reference to FIGS. 4*a*, 4*b* and 5. The system 600 further comprises a control unit 601 including current outputs 602 and 603 that are configured to allow the provision of currents, the magnitude and direction of which may be varied in a timely manner.

In other embodiments, when electrodes or electrode segments, as shown in FIGS. 4*a* and 4*b*, are to be operated, a plurality of outputs 602 and 603 may be provided which allow control of the height and polarity of a voltage in a time dependent manner.

In operation, the control unit 601 applies a current to the respective solenoids 641 so that a specified magnetic field, as indicated by 604, is created. Depending on the required thickness profile and the actual arrangement of the solenoids 641, a time-constant magnetic field may be appropriate to obtain a required thickness profile. In the example shown in FIG. 6, however, the currents provided by the outputs 602 and 603 are supplied to the solenoids 641 in a time dependent manner so as to generate a time dependent magnetic field and thus a time dependent deflection of ions passing through the diffuser element. In FIG. 6, the general direction of ions is perpendicular to the drawing plane and the direction of deflection of the ions is also perpendicular to the presently prevailing magnetic field 604. For example, the currents provided at the outputs 602 and 603 may be varied sinusoidally with a phase difference of 90° so that a rotating magnetic field with constant magnitude is obtained that may lead to a relatively uniform ion distribution. However, any type of time dependent magnetic field may be generated by correspondingly providing currents at the outputs 602 and 603. Similarly, corresponding voltages may be supplied to the electrodes or electrode segments as shown in FIGS. 4*a* and 4*b*, when a diffuser element is used comprising electrodes. In particular, the embodiments described with reference to FIG. 4*b* may be operated in a similar fashion so that either a static or a time dependent electrical field provides a corresponding required deflection of ions passing through the passages 413.

As a result, the electromagnetic diffuser elements described with reference to FIGS. 4*a*, 4*b*, 5 and 6 allow, without or in combination with diffuser plates having passages formed therethrough, the remote control of the trajectories of ions flowing to the workpiece 109. Thus, the diffuser configuration may be easily and quickly modified to conform with process requirements. Moreover, the diffuser configuration may be varied during processing of a single substrate so as to obtain more sophisticated thickness profiles. For example, non-uniformities of pattern structures provided on the workpiece 109, or variations of the seed layer provided prior to plating the workpiece 109, or complex process variations of a subsequent process, for example a CMP process, may be taken into account by correspondingly selecting the configuration of the electromagnetically controlled diffuser element. A corresponding selection of a required deposition profile may, however, also be obtained by appropriately configuring the diffuser elements as described with reference to FIGS. 2 and 3; in this case, a remote control of diffuser configuration would, however, require a complex mechanical control system.

Moreover, as already pointed out with the mechanical diffuser elements in FIGS. 2 and 3, the electromagnetically controlled diffuser elements explained with reference to FIGS. 4–6 allow adaptation of the diffuser configuration to workpieces of different sizes and shapes so that a plurality of substrates may be processed without changing the mechanical construction of the electroplating system 100, and even without mechanically manipulating the diffuser elements. In some embodiments, the diffuser elements may be operated in a "digital" or "pixel-like" manner, wherein passages are virtually "blocked" in that the deflection angle is increased by the electric and/or magnetic field in a way that ions will not hit the work piece or are directed to a neighboring passage, where the ions are re-directed in conformity with the field prevailing at the neighboring passage.

Figure 7A:
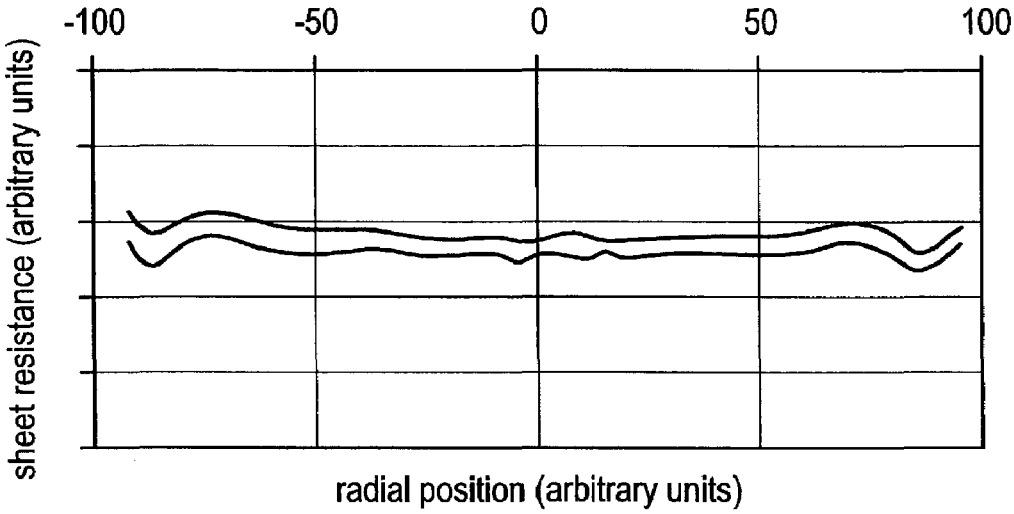
FIGS. 7*a* and 7*b* show respective measurement results of a thickness profile obtained by two different configurations of the diffuser element as shown in FIGS. 2 and 3.

FIG. 7*a* shows a graph depicting the thickness variation of a copper layer plated on an unstructured semiconductor wafer. The thickness profile is evaluated by means of the sheet resistance measured at various positions along the radius of the semiconductor wafer. As is evident from FIG. 7*a*, a uniform thickness distribution is obtained, wherein during the deposition process the diffuser element as shown in FIG. 2*a* has been used with the peripheral passages 213 partially closed to reduce the deposition rate at the periphery of the semiconductor wafer.

Figure 7B:
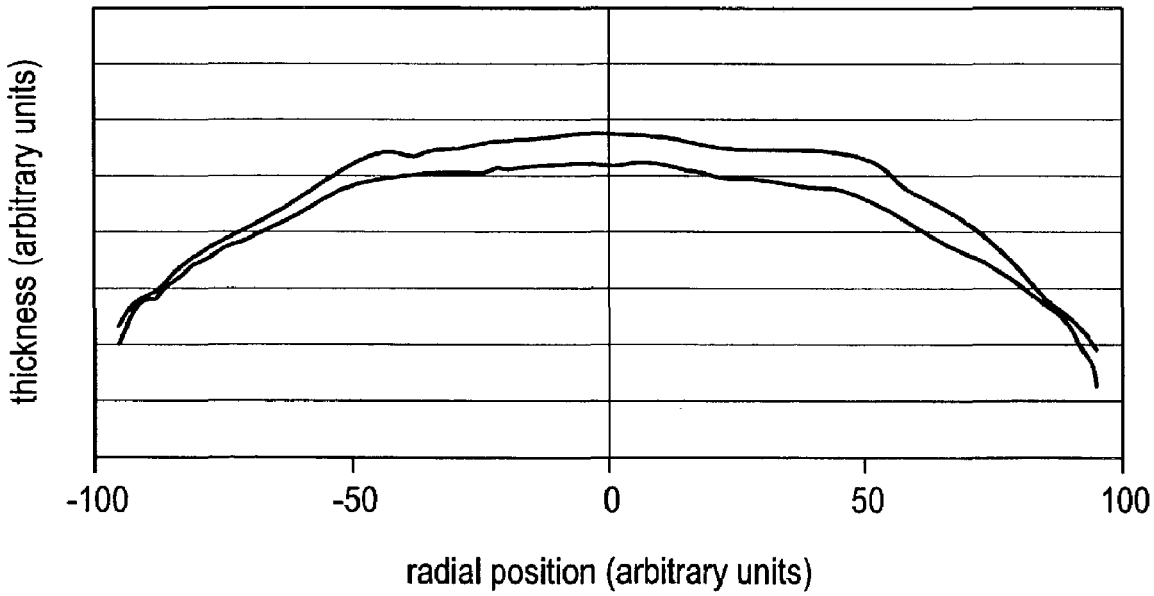

FIG. 7*b* schematically shows a diagram representing the thickness of a copper layer formed on an unstructured semiconductor wafer with respect to the radial position of the wafer. The diffuser configuration of the diffuser elements, as described with reference to FIGS. 2 and 3, has been correspondingly adjusted to obtain a dome-like profile so as to compensate for the increased removal rate at the center of the wafer in a subsequent CMP process.

Further modifications and variations of the present invention will be apparent to those skilled in the art in view of this description. Accordingly, the description is to be construed as illustrative only and is for the purpose of teaching those skilled in the art the general manner of carrying out the present invention. It is to be understood that the forms of the invention shown and described herein are to be taken as the presently preferred embodiments.

What is claimed is:

1. A diffuser element for a plating reactor, comprising:

a plurality of passages;

a first pattern of passages formed in a first diffuser plate;

a second pattern of passages formed in a second diffuser plate; and an adjustment mechanism configured to hold in place the first and second patterns with a selected rotational offset between each other, wherein said adjustment mechanism comprises one or more engagement elements at an edge region of the first and second patterns.

2. The diffuser element of claim 1, wherein said adjustment mechanism is configured to allow the individual selection of the effective size of at least some of the plurality of passages.

3. The diffuser element of claim 1, wherein said adjustment mechanism is configured to allow the adjustment of the effective size of a group of passages.

4. The diffuser element of claim 1, wherein said passages are arranged so as to avoid symmetry with respect to a center point of the diffuser element.

5. A diffuser element for a plating reactor, comprising:

a first pattern of openings and a second pattern of openings, wherein the first and second patterns are adjustably attached relative to each other such that a degree of overlap of openings in the first and second patterns is controllable; and an adjustment mechanism configured to hold in place the first and second patterns with a selected rotational offset between each other, wherein said adjustment mechanism comprises one or more engagement elements at an edge region of the first and second patterns.

6. The diffuser element of claim 5, further comprising an adjustment mechanism configured to continuously vary said degree of overlap.

7. The diffuser element of claim 5, wherein the first pattern is provided in a first diffuser plate and the second pattern is provided in a second diffuser plate.

8. The diffuser element of claim 5, wherein at least one of the first and second pattern is devoid of symmetry with respect to a central point of the first and second patterns.

9. The diffuser element of claim 5, wherein at least some of the openings of the first and second patterns differ from each other in at least one of size and shape.

10. A plating reactor, comprising:

a substrate holder configured to hold a workpiece in place;

a diffuser element positioned in front of said substrate holder, wherein the diffuser element comprises a first pattern of openings and a second pattern of openings; and an adjustment mechanism configured to hold in place the first and second patterns with a selected rotational offset between each other, wherein said adjustment mechanism comprises one or more engagement elements at an edge region of the first and second patterns.

11. A plating reactor comprising:

a substrate holder adapted to hold a workpiece in place;

a diffuser element arranged in front of said substrate holder and including a first pattern of passages and a second pattern of passages, wherein the first and second patterns are movably attached relative to each other to allow a variation of a degree of overlap of the passages of the first and second patterns; and an adjustment mechanism configured to hold in place the first and second patterns with a selected rotational offset between each other, wherein said adjustment mechanism comprises one or more engagement elements at an edge region of the first and second patterns.

12. A method of plating the surface of a workpiece, the method comprising:

providing a substrate holder configured to hold the workpiece in place;

providing an electrolyte at least in front of the workpiece;

providing a diffuser element in front of the workpiece surface, wherein the diffuser element is configured to allow adjusting an effective size of passages formed in the diffuser element;

providing an adjustment mechanism configured to hold in place the first and second patterns with a selected rotational offset between each other, wherein said adjustment mechanism comprises one or more engagement elements at an edge region of the first and second patterns; and directing electrolyte towards the workpiece surface, wherein a configuration of the diffuser element is selected by operating said adjustment mechanism to adjust the effective size of the passages to thereby provide for a required deposition rate on the workpiece.

* * * * *